US005319827A

United States Patent [19]

Yang

[11] Patent Number: 5,319,827

[45] Date of Patent: Jun. 14, 1994

[54] DEVICE OF SENSING DUST FOR A VACUUM CLEANER

[75] Inventor: Byung S. Yang, Kyung Sang Nam-Do, Rep. of Korea

[73] Assignee: Gold Star Co., Ltd., Seoul, Rep. of Korea

[21] Appl. No.: 929,576

[22] Filed: Aug. 14, 1992

[30] Foreign Application Priority Data

Aug. 14, 1991 [KR] Rep. of Korea ..... 91-12912

[51] Int. Cl.[5] ..... A47L 9/28

[52] U.S. Cl. ..... 15/319; 15/339; 250/574; 356/438

[58] Field of Search ..... 15/319, 339; 250/239, 250/573, 574; 356/438; 138/44

[56] References Cited

U.S. PATENT DOCUMENTS

| | | | |
|---|---|---|---|
| 1,857,321 | 5/1932 | Nemec | 138/44 |
| 1,940,921 | 12/1933 | Smith | 138/44 |
| 2,918,585 | 12/1959 | Farmer | 250/239 |
| 4,001,581 | 1/1977 | Murata | 250/239 |
| 4,282,430 | 8/1981 | Hatten et al. | 250/239 |
| 4,592,390 | 6/1986 | Boyd | 138/44 |
| 4,937,912 | 7/1990 | Kurz | 15/339 |
| 5,085,058 | 2/1992 | Aaron et al. | 138/44 |
| 5,136,750 | 8/1992 | Takashima et al. | 15/319 |
| 5,144,715 | 9/1992 | Matsuyo et al. | 15/319 |
| 5,182,833 | 2/1993 | Yamaguchi et al. | 15/319 |

FOREIGN PATENT DOCUMENTS 0347223 12/1989 European Pat. Off. .

*Primary Examiner*—Philip R. Coe
*Assistant Examiner*—Reginald L. Alexander
*Attorney, Agent, or Firm*—Pennie & Edmonds

[57] ABSTRACT

A device for sensing the amount of dust, refuse, etc., flowing into a dust suction tubular member of a vacuum cleaner. The device comprises a light emitting element and photoreceptor, the light emitting element and photoreceptor facing each other with a dust path between them provided in the inside of the dust suction tubular member, a detector for detecting the amount of the light supplied from the light emitting element and photoreceptor from being flush with the inside of the dust suction tubular member, a ring-shaped projection formed in the inside of the dust suction tubular member for increasing the inflow speed of the air including dust, refuse, etc., through the space between the light emitting element and photoreceptor.

11 Claims, 2 Drawing Sheets

DEVICE OF SENSING DUST FOR A VACUUM CLEANER

TECHNICAL BACKGROUND

The present invention relates generally to a vacuum cleaner, and more particularly to a device for sensing the amount of dust, refuse, etc. flowing into the suction path of a vacuum cleaner so as to automatically adjust the dust suction force.

In a conventional vacuum cleaner, there is provided a device for sensing the amount of dust flowing into a suction path by means of a light emitting element and photoreceptor attached to the inside of the suction path facing each other, whereby the rotating speed of a fan motor is controlled so as to adjust the dust suction force. In this case, since the light emitting element an photoreceptor are exposed to the dust in the suction path, the dust accumulates on them, degrading the performance. In order to offset such performance degradation of the light emitting element and photoreceptor there has been proposed a dust sensing device for an electric cleaner disclosed in EPO Laid-Open Patent Publication No. 347, 223 published on Dec. 20, 1989.

In this publication, the light emitting element and photoreceptor are provided with covers that are attached flush with the inside of the suction path. In addition, there is also provided a surface which is outwardly sloped from the covers towards the inlet of the dust suction so as to increase the speed of the dust flow in the region of the light emitting element and photoreceptor, thus preventing the dust from being attached thereto by dust. In addition, the light radiating end of the light emitting element has a smaller diameter so as to prevent the dispersion of the light and thereby improve dust-sensing capability.

However, in such a dust-sensing device, the diameter of the suction path cannot provide a sloped surface of sufficient height, so that dust attaches to the covers of the light emitting element and photoreceptor thus degrading their sensing capability. Moreover, the light radiating end of the light emitting element is too small to precisely and sufficiently detect the amount of dust flow.

SUMMARY OF THE INVENTION

It is an object of the present invention to provide a device for sensing the amount of the dust flow in a vacuum cleaner, which prevents the dust from accumulating on the light emitting element and photoreceptor, thereby improving dust-sensing capability.

It is another object of the present invention to provide a device for sensing the amount of the dust flow in a vacuum cleaner, which device increases the range for sensing the dust flow sufficiently well to make a precise measurement of the amount of the dust flow.

According to the present invention, a device for sensing the amount of dust, refuse, etc. flowing into a dust suction tubular member of a vacuum cleaner comprises a light emitting element and photoreceptor, the light emitting element and photoreceptor facing each other with a dust path between them provided in the inside of the dust suction tubular member, detector means for detecting the amount of the light supplied from the light emitting element to the photoreceptor, cover means attached to the inside of the dust suction tubular member for preventing the light emitting element and photoreceptor from being attached to by dust, refuse, etc., the edge of the cover means being flush with the inside of the dust suction tubular member, ring-shaped projection means formed on the inside of the dust suction tubular member near the light emitting element and photoreceptor towards the air inlet of the dust suction tubular member for increasing the inflow speed of the air including dust, refuse, etc., through a space between the light emitting element and photoreceptor.

Preferably, the photoreceptor includes a light collecting plate for collecting the light of the light emitting element supplied to the photoreceptor.

The present invention will now be described more specifically with reference to the drawings attached only by way of example.

BRIEF DESCRIPTION OF THE ATTACHED DRAWINGS

DETAILED DESCRIPTION OF A CERTAIN PREFERRED EMBODIMENT

Figure 1:
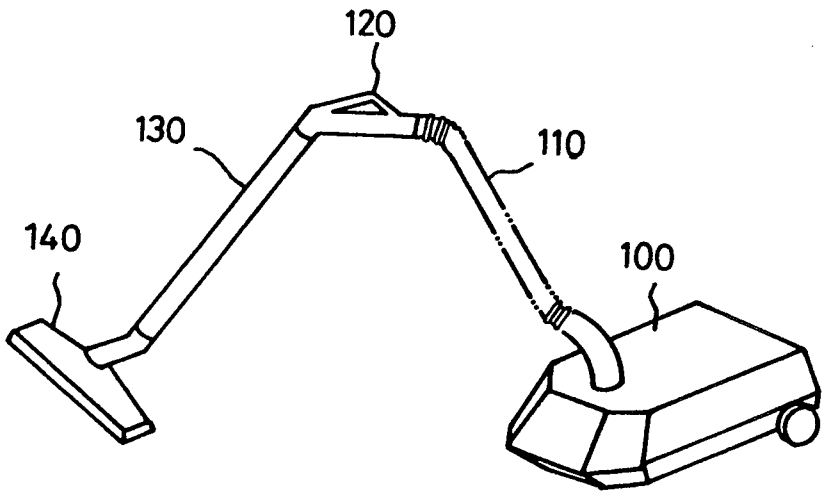
FIG. 1 is a perspective view of a vacuum cleaner.

Referring FIG. 1, there is illustrated a vacuum cleaner including a dust collecting body 100 adapted to move on the ground. The dust collecting body 100 of a vacuum cleaner includes a fan motor (not shown) for air suction, filter for filtering the air including dust, refuse, etc., and suction means to which is connected a hose 110. The front end of the hose 110 is connected with the rear end of a handle 120. The front end of the handle 120 is connected with the rear end of an extension tube 130, whose front end is in turn connected with a wipe nozzle 140.

The air including dust, refuse, etc., sucked by the wipe nozzle 140 flows through the extension tube 130, handle 120 and hose 110 into the filter of dust collecting body 100 of the vacuum cleaner. The air filtered by the filter is externally discharged by means of the fan motor.

Figure 2:
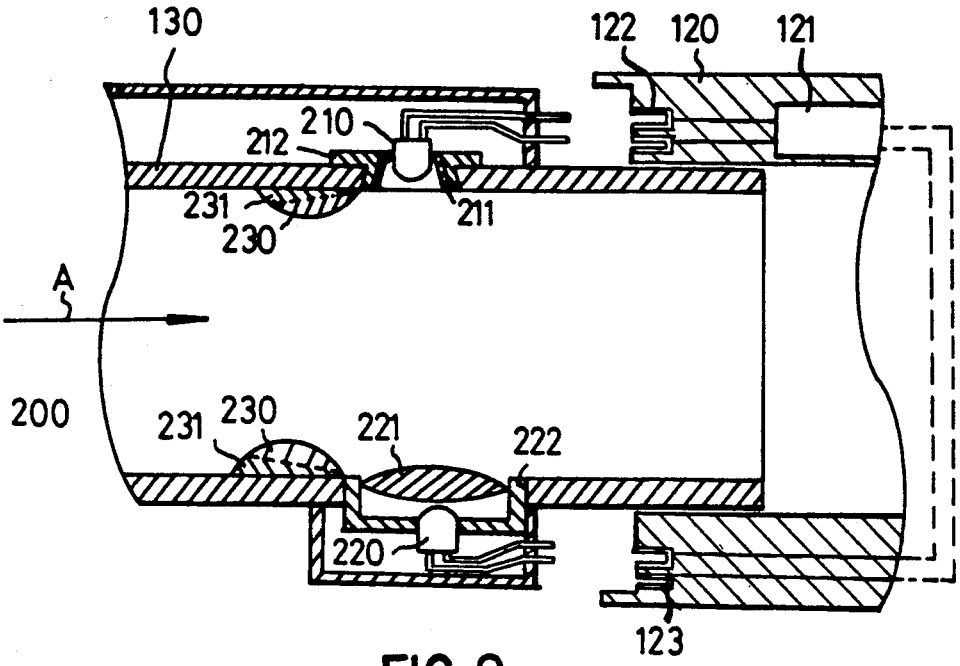
FIG. 2 is a cross-sectional view of a device for sensing the amount of the dust flow used in a vacuum cleaner according to an embodiment of the present invention.

FIG. 2 shows a device for sensing the amount of dust, refuse, etc., according to an embodiment of the present invention, which includes a light emitting element 210 and photoreceptor 220 arranged in the dust suction path of the extension tube 130. The light emitting element 210 is provided with a reflector 211 on which is mounted a transparent cover 212. The reflector 211 prevents the dispersion of the light of the light emitting element 210, so that the light is effectively supplied to the region of the photoreceptor 220. The light radiating end of the transparent cover 212 is made flush with the inside wall of the extension tube 130 (i.e., the wall of the dust suction path).

Meanwhile, the photoreceptor 220 is covered by a light collecting plate 221 formed of a convex lens. The light collecting plate 221 is positioned at the focus of the photoreceptor 220 flush with the inside wall of the extension tube 130 (i.e., the wall of the dust section path). The photoreceptor 220 and light collecting plate 221 are fixed in the extension tube 130 by means of a cover 222.

A ring-shaped projection 230 is formed in the inside wall of the extension tube 130 near the light emitting element 210 and photoreceptor 220 towards the air inlet of the extension tube 130 for increasing the inflow speed of the air including duct, refuse, etc., through the space or region between the light emitting element and photoreceptor The ring-shaped projection 230 includes cuts 231 formed in line with the light emitting element 210 and photoreceptor 220 towards the air inlet to further increase the inflow speed on the cover 212 and light collecting plate 221 positioned over the light emitting element 210 and photoreceptor 220.

Figure 3:
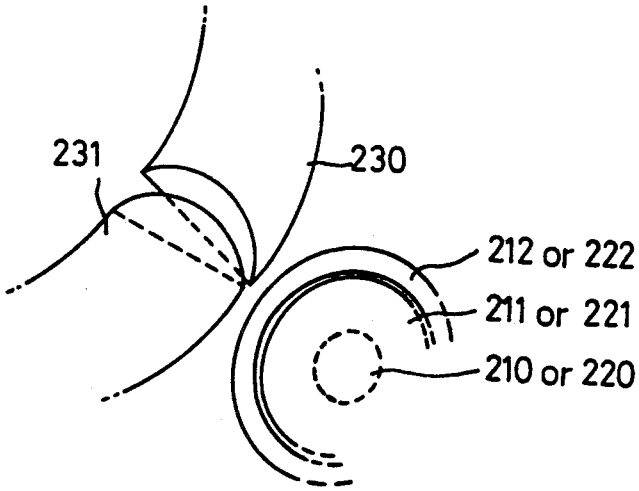
FIG. 3 is an enlarged perspective view of the cuts shown in FIG. 2.

As shown in FIG. 3, the cuts 231 have a reversed-triangular shape towards the light emitting element 210 and photoreceptor 220, so that the inlet is wide and the outlet narrow.

There are provided detector means 121 and electrical connection terminals 122 and 123 in the handle 120. The terminal 122 is connected with the electrical terminal of the light emitting element 210 when the handle 120 is mounted on the extension tube 130. At this time, the terminal 123 transfers to the detector means 121 the output signal of the photoreceptor 220 corresponding to the amount of light supplied from the light emitting element 210 to the photoreceptor 220.

In operation, the fan motor is driven for the air to be sucked through the suction path 200 together with dust, refuse, etc., as shown by arrow "A" in FIG. 2. The air including dust, refuse, etc., passes through the ring-shaped projection 230 accelerated because of the narrowed diameter portion of the suction path according to the Bernoulli Theorem. Furthermore, the speed of the air, including dust, is accelerated more in the regions near the light radiating end of the cover 212 and light collecting plate 221 than in the mid-region between them, so that dust hardly attaches to the surfaces of the light emitting radiating end of the cover 212 and the light collecting plate 221. The amount of light supplied from the light emitting element to the light collecting plate 221 is inversely proportional to the amount of dust. The light collecting plate 221 focuses the received light applied to the photoreceptor 220 to convert it into a corresponding electrical signal that is in turn applied through the terminal 123 to the detector means 121. Then the detector means 121 detects the amount of dust being sucked in according to the magnitude of the electrical signal from the photoreceptor 220, thereby controlling the rotating speed of the fan motor so as to adjust the dust suction force. The light flux of the light emitting element 210 is reflected by the reflector 211 maintained in a given size defined by the reflector 211 without dispersion. Preferably, the diameter of the light collecting plate 221 is large enough to collect the whole of the light flux reflected by the reflector 211.

As stated above, the ring-shaped projection with cuts arranged in the inside wall of the dust suction path before the light emitting element and photoreceptor increases the inflow speed of the air including the dust so as to prevent the dust from being attached to the surfaces of the light emitting element means and photoreceptor means, thus maintaining their performance at the highest possible level. In addition, the reflector and light collecting plate serve to prevent the dispersion of the sensing light and secure a sufficient dust sensing range, so that the amount of the dust being sucked in may be precisely detected. Finally, the light emitting element and photoreceptor arranged in the extension tube make it easy to do repairing and replacement.

What is claimed is:

1. A device for sensing the amount of particulate material flowing into a tubular suction member of a vacuum cleaner having a light emitting element and a photoreceptor in aligned relationship within a dust path defined by said tubular suction member, and a detector means for detecting the amount of the light supplied from said light emitting element to said photoreceptor, comprising:

a cover means for each of said light emitting element and said photoreceptor formed within said tubular suction member for preventing particulate material from adhering to said light emitting element and said photoreceptor, wherein one end of each of said cover means is flush with an inside surface of said tubular suction member; and ring-shaped projection means formed on said inside surface of said tubular suction member adjacent to and upstream of said light emitting element and said photoreceptor to increase the inflow speed of the air including particulate material through a space between said light emitting element and said photoreceptor, wherein said projection means includes cuts which form diverging channels, each channel having sidewalls formed by said cuts, which diverge toward and aligned with one of said light emitting element and said photoreceptor to further increase the speed of the air including particulate material passing over said cover means of said light emitting element and said photoreceptor.

2. A device as defined in claim 1, wherein said cover means for said photoreceptor includes a light collecting plate for collecting the light supplied to said photoreceptor by said light emitting element.

3. A device as defined in claim 2, further comprising a reflector concentrically disposed around said light emitting element for preventing dispersion of emitted light so as to limit light flux within a region of said light collecting plate.

4. A device as defined in claim 3, wherein said light collecting plate is a convex lens.

5. A device for sensing the amount of particulate material being collected in a vacuum cleaner having a dust collecting body for collecting particulate material through a tubular suction member operatively connected with said dust collecting body, comprising:

a light emitting element and a photoreceptor facing each other within a dust path defined by said tubular suction member for sensing the amount of particulate material flowing into said tubular suction member;

a transparent cover means for each of said light emitting element and said photoreceptor attached to said tubular suction member for preventing said particulate material from adhering to said light emitting element and said photoreceptor, wherein one end of each of said cover means is flush with an inside wall of said tubular suction member; and ring-shaped projection means formed on said inside wall of said tubular suction member adjacent to and upstream of said light emitting element and said photoreceptor to increase the inflow speed of the air including particulate material through a space between said light emitting element and said photoreceptor, wherein said projection means includes cuts which form diverging channels, each channel having sidewalls formed by said cuts, which diverge toward and aligned with one of said light emitting element and said photoreceptor to further increase the speed of the air including particulate material passing over said over means of said light emitting element and said photoreceptor.

6. A device as defined in claim 5, wherein said transparent cover means for said photoreceptor includes a light collecting plate for collecting the light supplied to said photoreceptor by said light emitting element.

7. A device as defined in claim 6, further comprising a reflector concentrically disposed around said light emitting element for preventing dispersion of emitted light so as to limit light flux within a region of said light collecting plate.

8. A device as defined in claim 7, wherein said light collecting plate is a convex lens.

9. In a vacuum cleaner of the type including a tubular suction member defining a suction path and means for collecting particulate material carried by air passing through said suction path, the improvement comprising:

means disposed adjacent said suction path for sensing the amount of particulate material passing therethrough;

cover means positioned within said tubular suction member for preventing the adherence of said particulate material on a surface of said sensing means facing said suction path; and velocity increasing means positioned adjacent to and upstream of said sensing means for increasing the velocity of air traveling past said sensing means, wherein said velocity increasing means is defined by a ring shaped projection formed adjacent to and upstream of said sensing means on the inside wall of said tubular suction member to increase the velocity of flowing air past said sensing means, said ring shaped projection includes cuts which form diverging channels, each channel having sidewalls formed by said cuts which diverge toward and aligned with said sensing means to further increase the speed of the air passing over said sensing means.

10. An improvement of claim 9, wherein said sensing means includes a light emitting device which emits light across said suction path and a light sensing device for receiving light emitted by said emitting means.

11. An improvement according to claim 9, wherein said projection is an annular projection formed with said diverging channels.

* * * * *